US005099461A

United States Patent [19]

Fitzgerald

[11] Patent Number: 5,099,461

[45] Date of Patent: Mar. 24, 1992

[54] UNDERWATER ELECTROACOUSTIC TRANSDUCERS

[76] Inventor: James W. Fitzgerald, 81 Faire Harbour Pl., New London, Conn. 06320-4710

[21] Appl. No.: 310,195

[22] Filed: Feb. 14, 1989

[51] Int. Cl.[5] ..... H04R 17/00

[52] U.S. Cl. ..... 367/160; 367/157; 367/165; 367/174; 310/337; 310/323; 310/330

[58] Field of Search ..... 367/157, 160, 161, 165, 367/173; 310/337, 378, 329, 330, 334, 322, 323; 181/171, 172

[56] References Cited

U.S. PATENT DOCUMENTS 3,704,385 11/1972 Schweitzer et al. ..... 310/322
3,982,142 9/1976 Goble ..... 310/322
4,010,441 3/1977 Richard ..... 310/322
4,131,874 12/1978 Geohegan ..... 310/337
4,429,247 1/1984 Feldman ..... 310/322
4,593,160 6/1986 Nakamura .

*Primary Examiner*—Charles T. Jordan
*Assistant Examiner*—J. Woodrow Eldred

[57] ABSTRACT

The FLEXBAR is a sonar transducer element that is basically a piezoceramic "free-free" flexure bar, but modified so as to radiate as a "monopole" rather than as a "dipole", and retaining the unique properties of being nodally mounted and dynamically balanced. One of the important consequences of this simple modification is the fact that the reaction forces on the FLEXBAR mountings and, the concomitant structure-borne vibrations, are virtually eliminated. This property, and related properties, result in unexpected but significant improvement in the performance of low-frequency, high-power, board-band sonar transducer arrays.

22 Claims, 10 Drawing Sheets

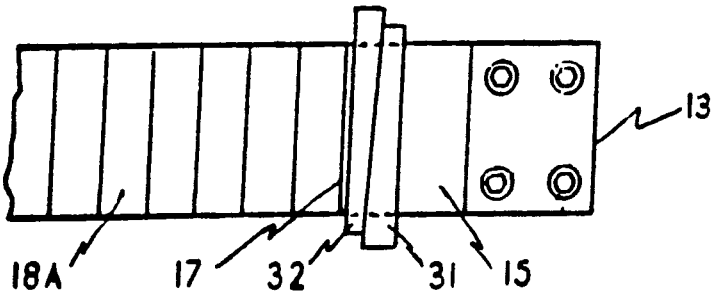
FIG.6-A
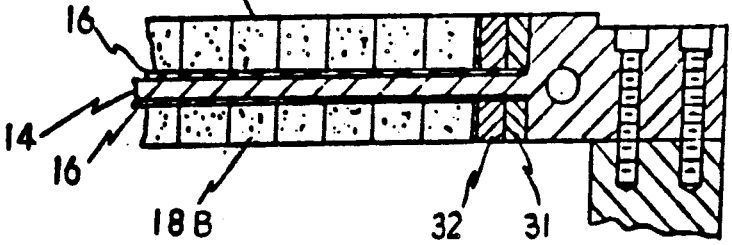
FIG. 6-B
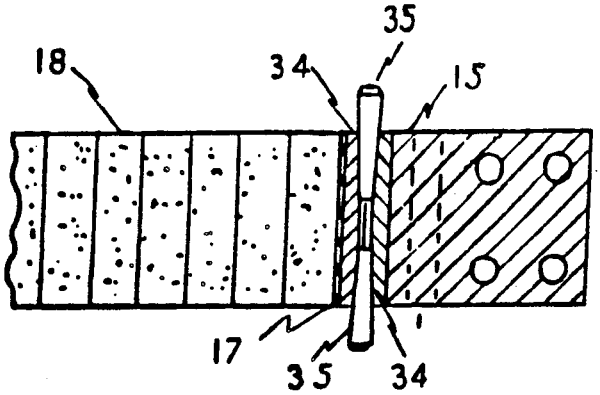
FIG. 7
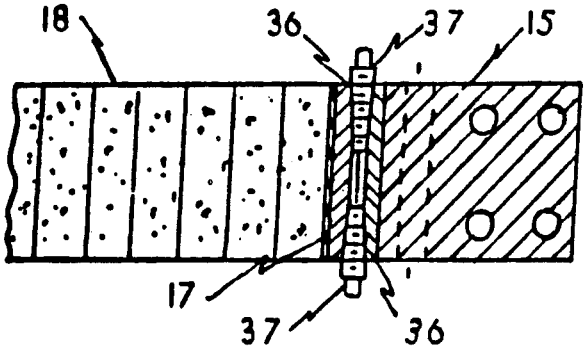
FIG. 8

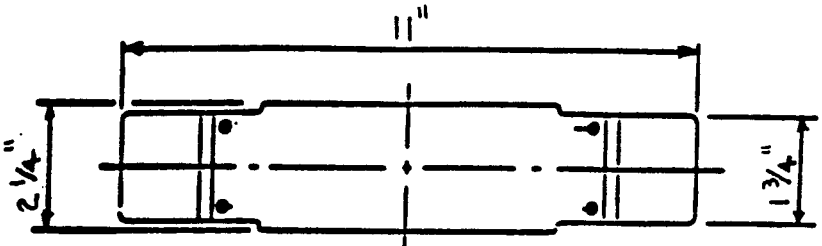
FIG. 9-A
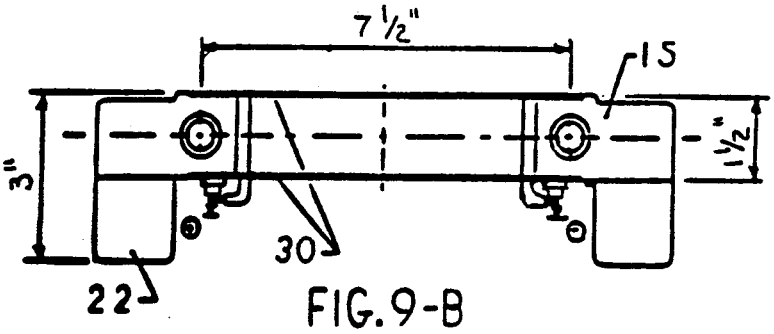
FIG. 9-B
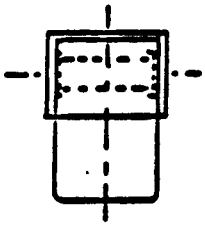
FIG. 9-C
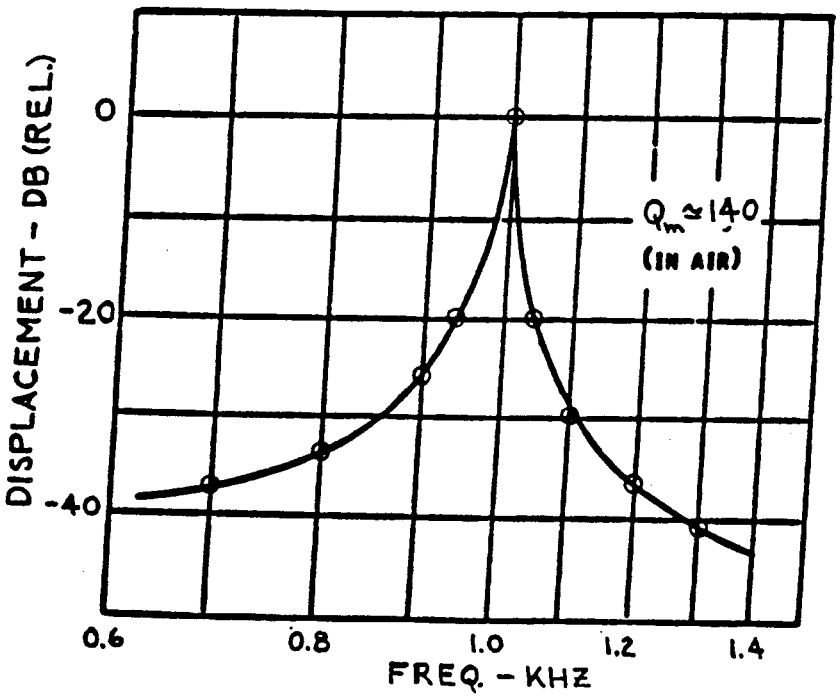
FIG. 10

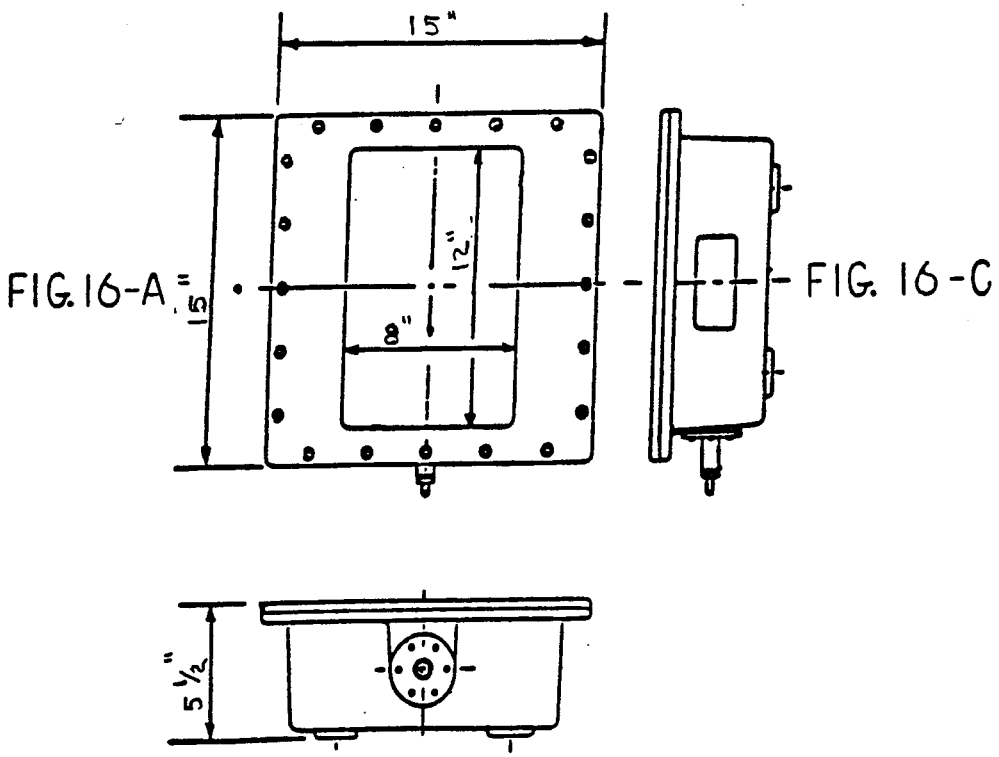
FIG. 16-A
FIG. 16-C
FIG. 16-B
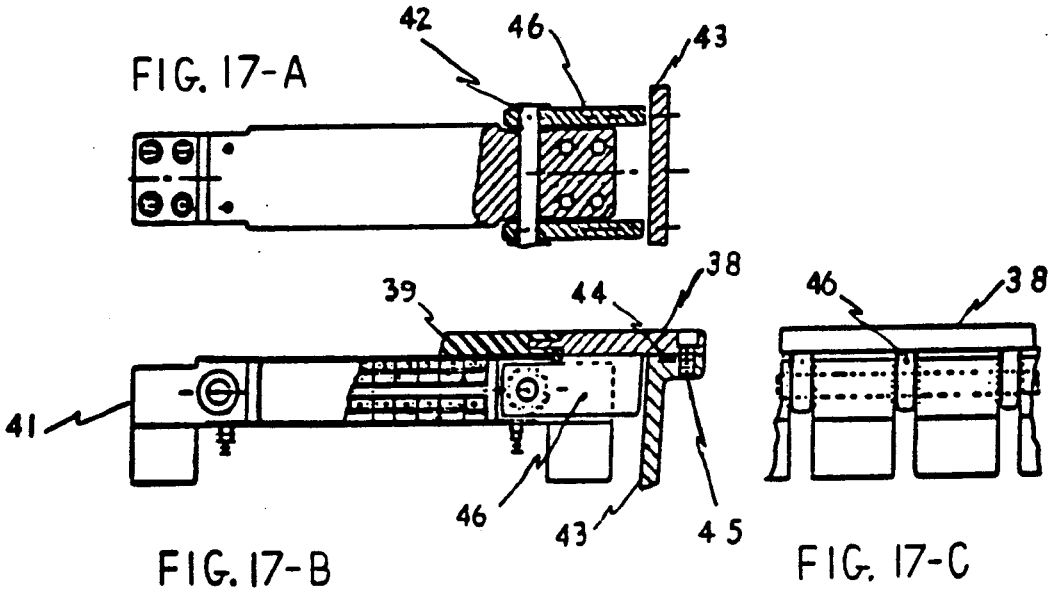
FIG. 17-A
FIG. 17-B
FIG. 17-C

UNDERWATER ELECTROACOUSTIC TRANSDUCERS

FIELD OF THE INVENTION

My invention relates to underwater electroacoustic transducers, and more particularly to improvements in flexural-bar type acoustic sources for use in sonar systems.

BACKGROUND OF THE INVENTION

The U.S. Navy, recognizing the need for low-frequency, high-power sonar projectors, initiated in the early 1960's, an active program for the development of piezoceramic flexural-bar transducers, utilizing both in-house Navy laboratories and contractural development through industrial laboratories. The effort has concentrated almost exclusively on the so-called "bender-bar", which is a flexural-bar with "hinged-hinged" end conditions. The development effort has been extensive and continuous, and culminated in a definitive study by R. S. Woollett, *The Flexural Bar Transducer,* published (posthumously) by the Naval Underwater System Center, New London, Conn., in 1986.

In spite of the Navy's and Industry's vigorous program, extending over some 25 years, to improve the performance of bender-bar transducers, a number of inherent, generic problems remain. The bender-bar mountings, for example, inevitably result in loss of power due to structure-borne vibration and can create a severe ship or submarine habitability problem for hull-mounted transducer arrays. In addition, for hull-mounted, deployable, and towable sonar projector arrays, the bender-bar coupling through its mounting results in complex, spurious modal response that aggravates the array mutual impedance problems, severely limits the acoustic power output, and often results in unwanted back radiation.

The theoretical end conditions for an ideal hinged-hinged flexure bar (the bender-bar) are: (1) the end deflections must be zero ($y=0$ for $x=0$ and $x=L$), and (2) the end bending moments must be zero ($d^2y/dx^2=0$ for $x=0$ and $x=L$). The extensive prior art has evolved three principal mounting designs for bender-bars; viz: (1) the pin-hinge; (2) the flange-hinge; and (3) the leaf-hinge. To some degree all three design approaches can be made to yield end bending moments that are small, but none of these can achieve the other requirement of end deflections being small, without adding excessive mass to the mounts. Attempts have also been made to cancel the reaction of the bender-bar on its mounting by utilizing a second bender-bar vibrating in opposite (180°) phase. This is an expensive solution, since it doubles the number of bender-bars, and of course, doubles the weight. Furthermore, it is of limited value since it is virtually impossible to match bender-bars so as to have equal amplitude and opposite phase (180°) over the required frequency band pass. This crowded prior art is set forth in some detail in Wollett's book, referred to above.

SUMMARY OF THE INVENTION

The conventional wisdom of the sonar community has been that, "The free-free bar is free of external applied forces or reaction forces . . . such a bar has no useful applications as an underwater transducer." (R. S. Woollett, *The Flexural Bar Transducer,* 1986, p. 203). This viewpoint presumeably has its origins in the fact that, unmodified, the free-free flexure bar radiates as an acoustic dipole with the concomitant poor radiation loading. The present invention relates to a method and means for modifying the free-free bar so that it radiates as a monopole, with greatly improved radiation loading. At the same time, the modified free-free bar retains the unique properties of being (a) nodally mounted and (b) dynamically balanced. As a direct result of these properties, the modified free-free bar has substantially zero mechanical reaction on its mounts, and exhibits essentially no structure-borne vibration. These characteristics, together with high efficiency, relatively low cost and other related properties, make this transducer element demonstrably superior to the bender-bar in virtually all sonar projector applications. To distinguish this innovative modified free-free flexure bar from the conventional hinged-hinged "bender-bar", I have named it the "FLEXBAR" and this terminology will be used throughout the remaining portions of this patent specification.

OBJECTS OF THE INVENTION

It is a principle object of my invention, the FLEXBAR, to provide a flexure bar sonar projector element that overcomes the inherent, generic problems of bender-bar element; viz, problems associated with mechanical reaction on its mountings. Further objects of my invention are to provide a flexure bar sonar projector element that:

- radiates as a monopole (rather than a dipole),
- has true nodal mounts ("keep your nodes clean"),
- has a simple, fundamental free-free bar flexure resonant mode ("keep your modes clean"),
- is dynamically balanced (virtually no reactive forces on its mountings),
- has a high electromechanical coupling coefficient (~0.6),
- has a high efficiency (~70%),
- can be effectively mechanically biased (for high-power applications),
- is mechanically tunable (over ~1 octave),
- is suitable for almost any acoustic array configuration (plane, cylindrical, spherical, conformal, etc.),
- is suitable for low-frequency arrays (over a range, 20 Hz to 2000 Hz),
- is suitable for high-power array, (e.g., 0.5 mega watts acoustic output),
- is suitable for broad-band arrays (~1 active),
- can be utilized in surface ship or submarine sonar projector arrays (either sonar dome arrays or conformal arrays),
- can be designed for use as an acoustic source for towed sonars or deployable sonars (e.g., active sonobuoys),
- is capable of high acoustic power-weight ratios (typically 20 to 30 watts/pound, in water),
- exhibits unilateral acoustic radiation (one face only) with a high front-to-back radiation ratio (~60 dB),
- has excellent heat dissipation (a direct thermal path to the ocean), and
- is both easy to fabricate and easy to maintain quality control (individual elements can be readily mechanically tuned to within ~1 Hertz).

Other objects and advantages of my invention will become apparent to those skilled in the art by perusal of the following detailed description and the attendant figures and claims.

BRIEF DESCRIPTION OF THE DRAWINGS

The present invention is illustrated by the accompanying drawings of which:

FIG. 7 is a sketch showing the "taper-pin" method of applying a precompression mechanical bias to the piezoceramic stacks of the FLEXBAR, FIG. 8 is a sketch showing the "taper-threaded plug" method of applying a precompression mechanical bias to the piezoceramic stacks of the FLEXBAR, FIG. 9-A is a top-view of a FLEXBAR designed for a resonant frequency of ~1 KHz, FIG. 9-B is a side-view of the FLEXBAR of FIG. 9-A, FIG. 9-C is an end-view of the FLEXBAR of FIG. 9-A, FIG. 10 is a curve showing the relative displacement of the center of the FLEXBAR of FIG. 9-B measured in air, as a function of frequency.

FIG. 16-C is a side view of the FLEXDUCER module of FIG. 16-A,

FIG. 17-A is a top-view sectional sketch showing design details of a FLEXBAR mounting, FIG. 17-B is a side-view sectional sketch showing design details of a FLEXBAR mounting, FIG. 17-C is an end-view sketch showing design details of FLEXBAR mountings.

PRINCIPLE OF THE FLEXBAR

Figure 1:
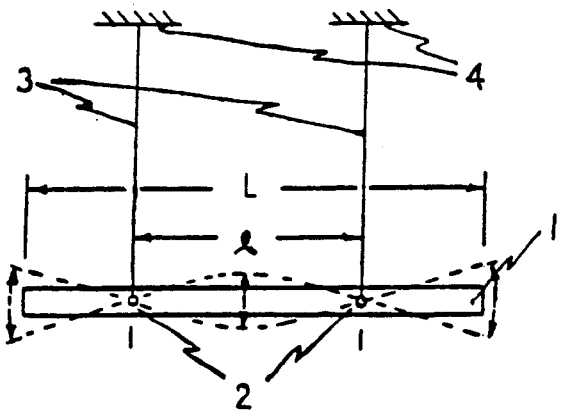
FIG. 1 is a schematic sketch of a free-free bar vibrating in flexure at its lowest mode.

The basic principle of my invention, the FLEXBAR sonar projector element, can be readily understood by referring to FIG. 1 through FIG. 4. FIG. 1 depicts an ideal elastic uniform free-free bar, 1, excited by some means so as to vibrate freely in its lowest, fundamental flexure mode. Under this condition two nodes, 2, develop, which represent points (or lines) of no vibration. The section of the bar between the nodal points vibrates in opposite phase to the outer sections; i.e., when the center section is flexing upward, the outer sections are flexing downward, and vice versa. Since no external forces are acting on the bar, the total momentum (both translational and rotational) must be zero; and this leads to the requirement that the total momentum of the center section must be equal (and of opposite phase) to the sum of the total momentum of the end sections. This requirement is sufficient to determine the location of the nodal points, as shown in FIG. 1, and thus, the nodal spacing is $l=0.552\times L$, where L is the overall length of the bar.

One of the interesting properties of the free-free bar is that it can be hung from its nodal points, 2, by threads, 3, from overhead supports, 4; then, when the bar is excited in high amplitude vibrations at its fundamental frequency, the threads experience no vibratory reaction forces, and are subjected only to the static force corresponding to the weight of the bar.

Figure 2:
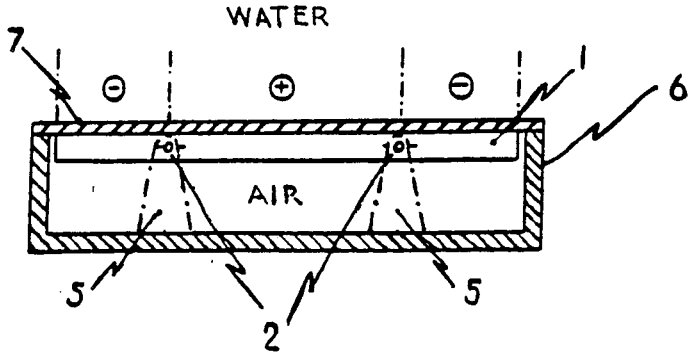
FIG. 2 is a schematic sketch of a free-free bar nodally mounted in a water-tight housing and radiating underwater as an acoustic "dipole"

FIG. 2 shows a schematic representation of a free-free bar as an underwater acoustic source. The free-free bar, 1, is mounted on its nodal points, 2, by means of suitable mounting brackets, 5, in an appropriate housing, 6. An acoustically transparent rubber window, 7, is bonded to the radiating surface of the bar and to the housing so as to form a water-tight seal, while at the same time allowing the bar to vibrate relatively freely. Air at the same pressure as the water, depending on the depth, fills the interior of the housing, resulting in acoustic radiation into the water only.

Under these conditions, the free-free bar transducer radiates as a dipole, since the center section is vibrating 180° out of phase with the outer sections. As the center section of the bar moves up, it increases the water pressure (as indicated by the symbol ⊕); while at the same time the outer sections move down, decreasing the adjacent water pressure, (as indicated by the symbol ⊖). The reverse takes place on the succeeding portion of the vibration, when the center section is moving down and the outer sections are moving up. Thus much of the kinetic energy of the vibrating bar is wasted by hydrodynamically sloshing water back and forth between the adjacent zones. Such behavior interferes with the primary compressional acoustic waves and results in the poor acoustic radiation loading characteristic of a dipole source.

Figure 3:
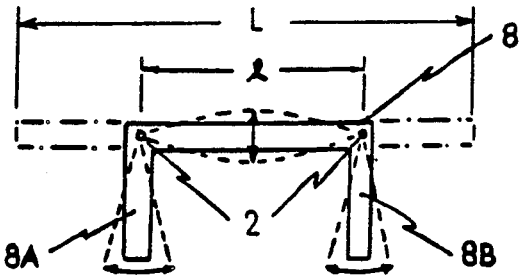
FIG. 3 is a schematic sketch of a modified free-free bar vibrating in its lowest mode.

Consider now, FIG. 3, where the outer sections, 8-*a* and 9-*b*, of the free-free bar, 8, of length L, are "bent" down at the nodal points, 2, at right angles to the center section. IF such a modified free-free bar is set into vibratory motion, it will have essentially the same resonant frequency and essentially the same location of nodal points as the original free-free bar. This results from the fact that the total inertia about the nodes of the "bent" ends sections are the same as the original straight end sections. In effect, the free-free bar sees "phantom" straight end sections. The modified free-free bar can also vibrate freely when suspended by threads.

The free-free bar can be further modified by shortening the "bent" end sections and increasing their cross-section and mass so as to maintain the same total inertia about the nodal points. This further modified free-free bar will still vibrate at the same fundamental resonant frequency as the original free-free bar, and with the same locations of nodal points. Such a flexure bar is what I have designated as a "FLEXBAR".

Figure 4:
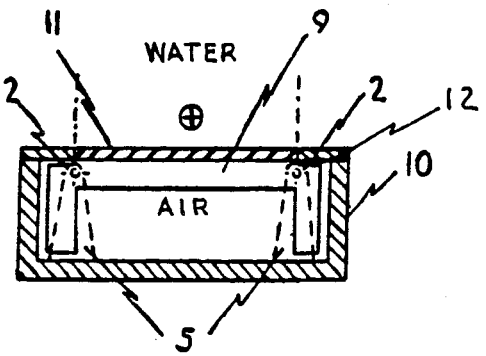
FIG. 4 is a schematic sketch of a modified free-free bar nodally mounted in a water-tight housing and radiating underwater as an acoustic "monopole"

FIG. 4, is a schematic representation of a FLEXBAR, as an underwater acoustic source. The FLEXBAR, 9, is mounted on its nodal points, 2, by suitable mounting brackets, 5, in an appropriate housing, 10. A combination cover-window, 11, is bonded to the radiating surface of the FLEXBAR so as to form a water-tight seal. The end-section masses have clearance from the cover plate in those areas, 12, beyond the nodal points so that the FLEXBAR can vibrate freely. As before, the interior of the housing is air filled so that the FLEXBAR radiates only into the water.

In this configuration, the center section between nodes is the only section of the FLEXBAR that is acoustically coupled to the water. The out-of-phase modified end sections vibrate entirely in the air-filled housing and are effectively decoupled from the water. This results in the desired monopole radiation, while at the same time the FLEXBAR is nodally mounted and essentially dynamically balanced. Thus, the FLEXBAR exhibits excellent radiation characteristics and virtually no reaction forces on the mountings and mechanical coupling to the housing.

This simple modification of the free-free flexure bar has unexpected, profound, and far-reaching consequences on the performance of low-frequency, high-power, broad-band sonar projector arrays.

A PREFERRED EMBODIMENT OF THE FLEXBAR

Figure 5:
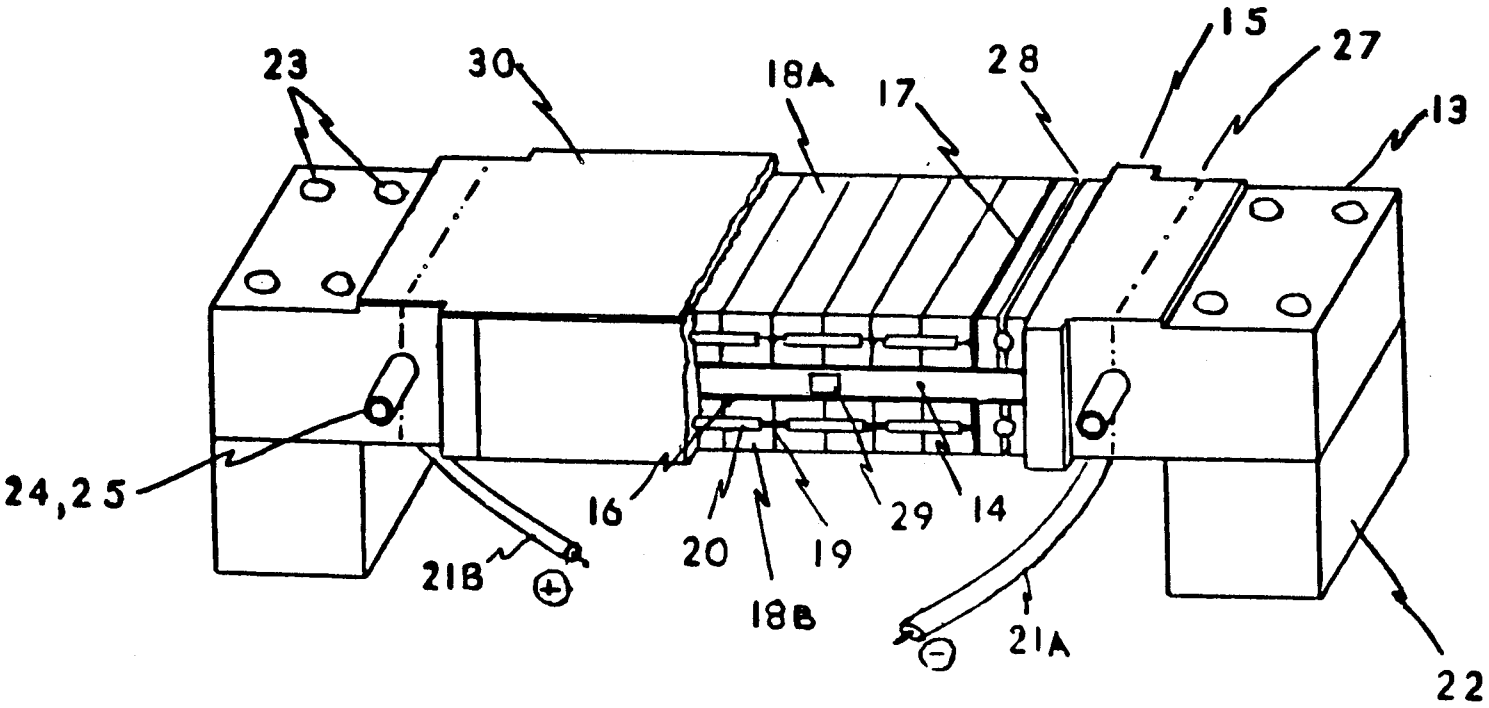
FIG. 5 is an isometric sketch showing a preferred embodiment of the "FLEXBAR" sonar transducer element, FIG. 6-A is a top view of the "wedge" method of applying a precompression mechanical bias to the piezoelectric stacks of the FLEXBAR, FIG. 6-B is a side-view section of the "wedge" method shown in FIG. 6-A.

A preferred embodiment of the FLEXBAR is shown in FIG. 5. It is of trilaminar construction; the center lamina of which is a metal bar, 13, of generally rectangular cross-section, with a relatively thin center web, 14, and enlarged ends, 15. Electrical insulation 16 and 17, line the inner sections of the metal bar, forming a top and bottom opening. Two outer laminae, 18-*a* and 18-*b*, consisting of a plurality of piezoceramic blocks with suitable electrodes, 19, and assembled with appropriate polarity, are placed in the top and bottom openings. The whole assembly, including the metal bar, 13, the insulation, 16 and 17, and the piezoceramic blocks, 18-*a* and 18-*b*, are consolidated into a solid composite bar by means of an electrically insulating cement. Electrical leads, 20, are connected to the piezoceramic block electrodes, 19, with appropriate polarity, with the leads, 21-*a* and 21-*b*, extending out from the inside bottom of the bar. Tuning masses, 22, are attached to the bar end sections, 15, by means of bolts, 23. Metal mounting pins, 24, with rubber tubing covers, 25, are inserted into hodal holes, 26, located on the center line of the bar at the nodal planes, 27, In order to minimize tensile strain in the brittle piezoceramic blocks, they are subjected to a precompression mechanical bias during assembly by means of the metal bias-blocks, 28, . . . said precompression being measured by resistance strain gages, 29, cemented to the center-web, 14, both top and bottom. Metal-clad plastic plates, 30, are cemented to the top and bottom of the bar to enhance its shock resistance. Finally, electrical conductors, 20, leading from the piezoceramic blocks are entirely imbedded in high dielectric strength cement in order to avoid electrical breakdown and corona discharge under the high drive voltages.

There are three different configurations of mechanical bias blocks that I have found useful in applying precompression bias to the piezoceramic blocks. The first of these methods is based on the use of wedges as shown in FIG. 6-A and FIG. 6-B. Here, pairs of wedges, 31 and 32, are inserted, top and bottom, at one end of the metal bar, 13, between the piezoceramic stacks, 18-*a* and 18-*b*, and both of the shoulders of the enlarged bar end section, 15. Electrical insulating pads, 17, between the wedge-pairs, 31 and 32, and the piezoceramic stacks, 18-*a* and 18-*b*, insulate the stacks from the bar ground potential. Each wedge has one parallel face and one inclined face and all inclined faces have the same incline angle. The wedge-pairs are assembled with the inclined faces mated. More-or-less equal, inward forces are applied along the main axis of the wedge-pairs (at right angle to the main bar axis), forcing the piezoceramic stacks against the shoulders of the enlarged bar end section, 15, at the opposite end of the metal bar. This results in tension stress in the bar center web, 14, and compression stress in the piezoceramic stacks, 18-*a* and 18-*b*. The amount of precompressional stress in the piezoceramic stack can be controlled by the incline angle of the wedges, the force applied to the wedges, the cross-sectional area of the center web and the tension modules of the material of the center web. The strain gages, 29, shown in FIG. 5, are used to measure the tension force in the web, which, of course, equals the compressive force in the piezoceramic stack. The whole process is most easily accomplished if the piezoceramic stacks, 18-*a* and 18-*b*, are preassembled with their insulation, 16 and 17, cemented in place. The cement is then applied between the center web, 14, and the insulating plates, 16. The stacks, 18-*a* and 18-*b*, are then placed on the bar and put into compression. The cement joint between the web, 14, and the insulating plates, 16, is allowed to set up with the stacks under compression, thus avoiding an unwanted shear stress in this cement joint. The protruding end of the wedges can then be cut off along the dotted lines, 33.

An alternative means for applying precompression is shown in the sectional sketch of FIG. 7. Here a pair of mechanical bias blocks, 34, with tapered holes drilled into each end of the block pair, are inserted between the piezcoceramic stack, 18, (with end insulating pad, 17) and the shoulder of the enlarged end section, 15, of the bar. The blocks are forced apart by driving two taper-pins, 35, into the tapered holes, resulting in precompression of the piezoceramic stack (and tension in the bar center web). In the somewhat similar method of FIG. 8, the tapered holes in the blocks, 36, are threaded and tapered, threaded plugs, 37, are screwed into the blocks, forcing them apart and, thus, precompressing the piezoceramic stack. As before, the protruding ends of the taper-pins or threaded-plugs can be removed after the inner cement joints have fully set-up.

The FLEXBAR shown in FIG. 5, can be set into flexural vibration by applying an alternating electrical voltage to the terminal, 21-*a* and 21-*b*. Since the piezoceramic stacks, 18-*a* and 18-*b*, are oppositely polarized, one half cycle of the resulting alternating current causes the upper stack to expand and the lower stack to contract; and in the next half of the cycle the opposite occurs. This results in the bar being driven in flexural vibration at the frequency of the applied alternating current. The amplitude of vibration is a maximum at the resonant frequency (lowest mode) of the FLEXBAR, which is given by the approximate formula:

$$f_0 = 0.31\ (a/l2)\ (c), \qquad (1)$$

where $f_o$ = the resonant frequency of the bar (Hz)

a = the thickness of the bar (inches)

l = the nodal length (inches)

c = effective longitudinal velocity of the bar (in/sec)

FIG. 9-A, FIG. 9-B, and FIG. 9-C are, respectively, the top-view, the side-view, and the end-view of an assembly drawing of a FLEXBAR designed for a resonant frequency of ~1000 Hz.

The FLEXBAR, 15, with a skeleton of brass, has a nodal length of 7½", an over-all length of 11", a thickness of 1½" and width of 2¼". The two ends of the bar have a reduced width of 1¾" to accommodate a mounting lug between adjacent FLEXBARs. Brass tuning weight, 22, are bolted to each end. Copper-clad glass-filled expoxy plates, 30, are cemented to the top and bottom of the bar in order to insulate the electrode ends and to "shock-harden" the bar. The total weight of the FLEXBAR of this design is approximately 9.75 lbs.

OPERATIONAL CHARACTERISTICS OF THE FLEXBAR

Figure 11:
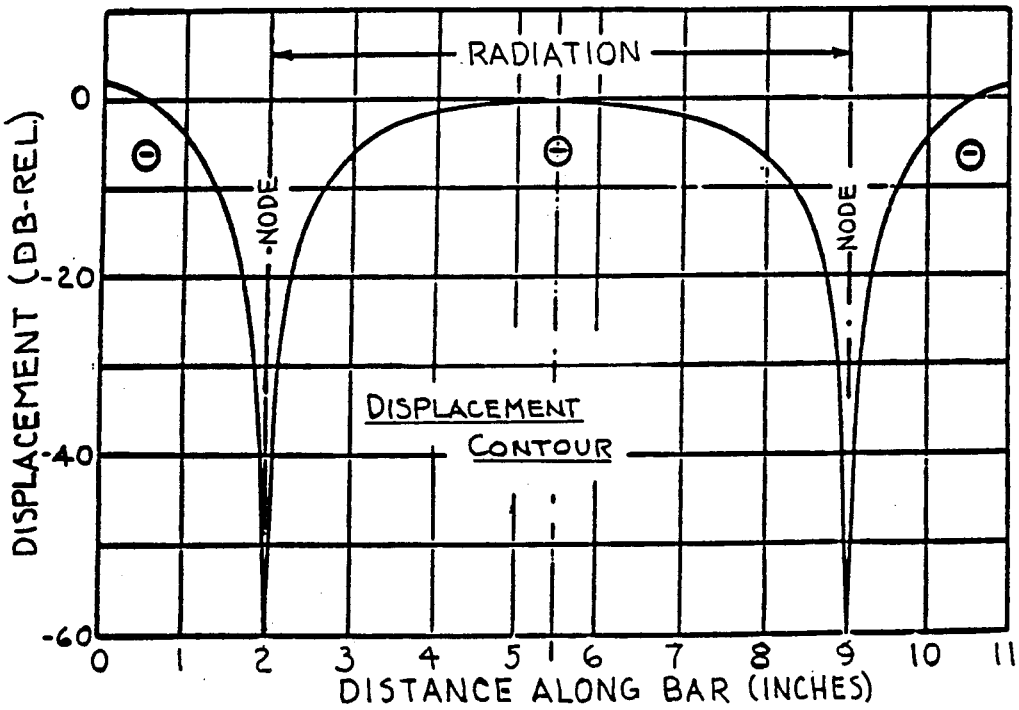
FIG. 11 is a curve showing the relative displacement along the FLEXBAR of FIG. 9-B, measured in air, as a function of distance along the bar.
Figure 12:
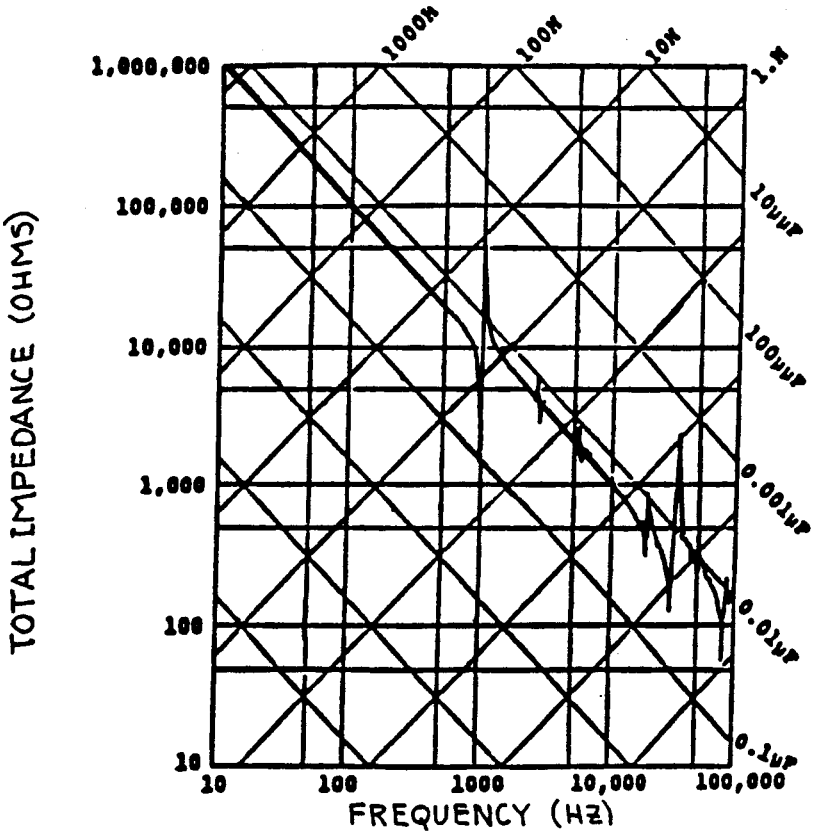
FIG. 12 is a curve showing the total impedance of the FLEXBAR of FIG. 9-B, measured in air, as a function of frequency.

FIG. 10 shows a typical measured relative (rms) displacement, in decibels, of the center of the FLEXBAR of FIG. 9-B, as a function of frequency. In this case the bar was measured in air and exhibited resonance at the design frequency. The high mechanical Qm ≃130 indicates that the bar has very low internal mechanical losses. FIG. 11 shows the measured relative displacement along the same FLEXBAR driven at its resonant frequency. The nodes are well defined and some 60 db below the center deflection. FIG. 12 shows the measured total impedance vs. frequency of the same FLEXBAR with a typical resonance-antiresonance at ~1 KHz. The next higher mode at ~2.75 KHz is nearly suppressed, but discernable, and the third mode at ~5.4 KHz, is also discernable. Above 10 KHz the bar breaks up into a number of complex resonant modes.

Figure 13:
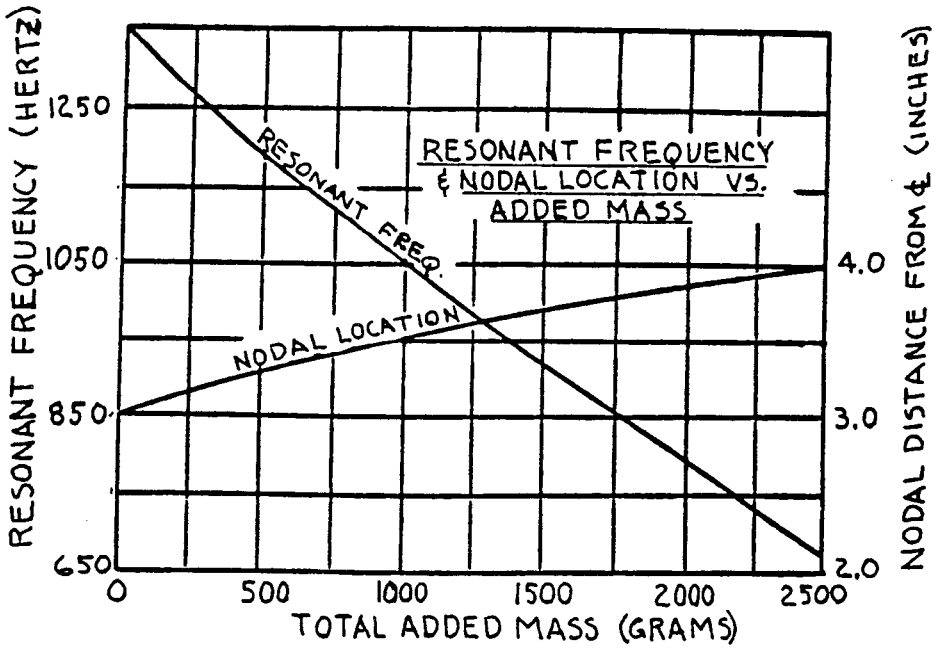
FIG. 13 is a curve showing the resonant frequency and the location of the nodes for the FLEXBAR of FIG. 9-B as a function of total added mass.
Figure 14:
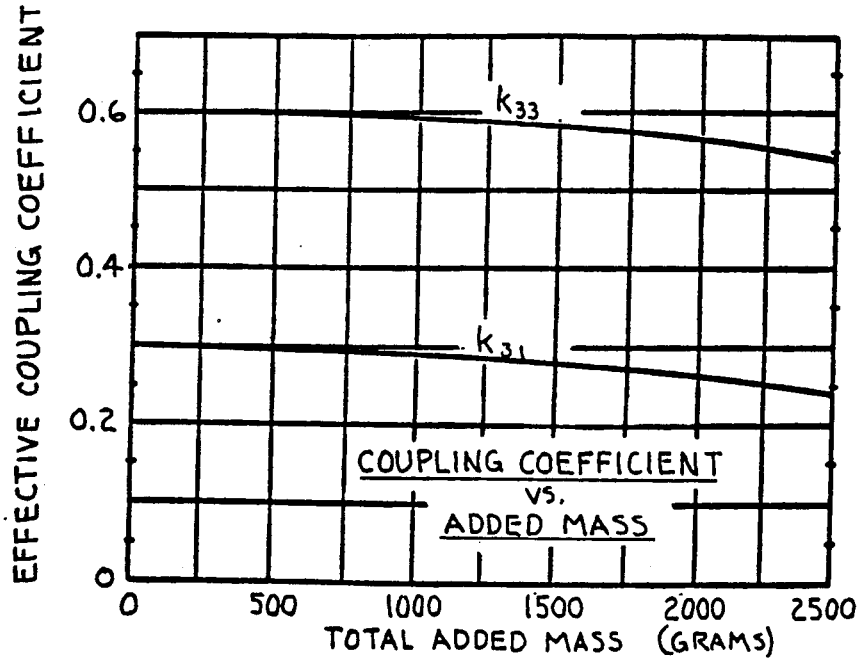
FIG. 14 is a curve showing the electromechanical coupling coefficients of the FLEXBAR design of FIG. 9-B as a function of total added mass for both $K_{33}$ and $K_{31}$ construction.

One of the remarkable and unique properties of the FLEXBAR is its capability of being mechanically tuned over approximately an octave, as shown in FIG. 13. This also represents experimental data obtained for the FLEXBAR shown in FIG. 9-B. The resonant frequency with no added "tuning" masses is ~1350 Hz, and this frequency is systematically reduced as mass is added. For a total added mass of 2500 grams (sum of mass at both ends). The resonant frequency is reduced to ~660 Hz, or approximately 1 octave lower. Also shown in FIG. 13, is the effect of added mass on the location of the nodal points. The effect is relatively small for such a wide range of frequencies representing approximately ±0.5 inches from the location for the design frequency. Since the nodal mounting pins, 24, of FIG. 5 are decoupled from the vibrating FLEXBAR by means of the compliant rubber sleeve, 25, the small movement of the nodal point location has little effect on the performance of the bar. For the design frequency of 1000 Hz, the total added mass is approximately 1200 gms, or 600 gms on each end. As can be seen from FIG. 14, this wide range of added mass has negligible effect on the electromechanical coupling coefficient of the FLEXBAR.

An important consequence of these unique properties is the fact that production runs of FLEXBARs can be easily all tuned to the same nominal design frequency by adding or subtracting small amounts of mass from the end tuning masses. This results in improved quality control and reduced cost.

A FLEXBAR TRANSDUCER: THE FLEXDUCER

Figure 15:
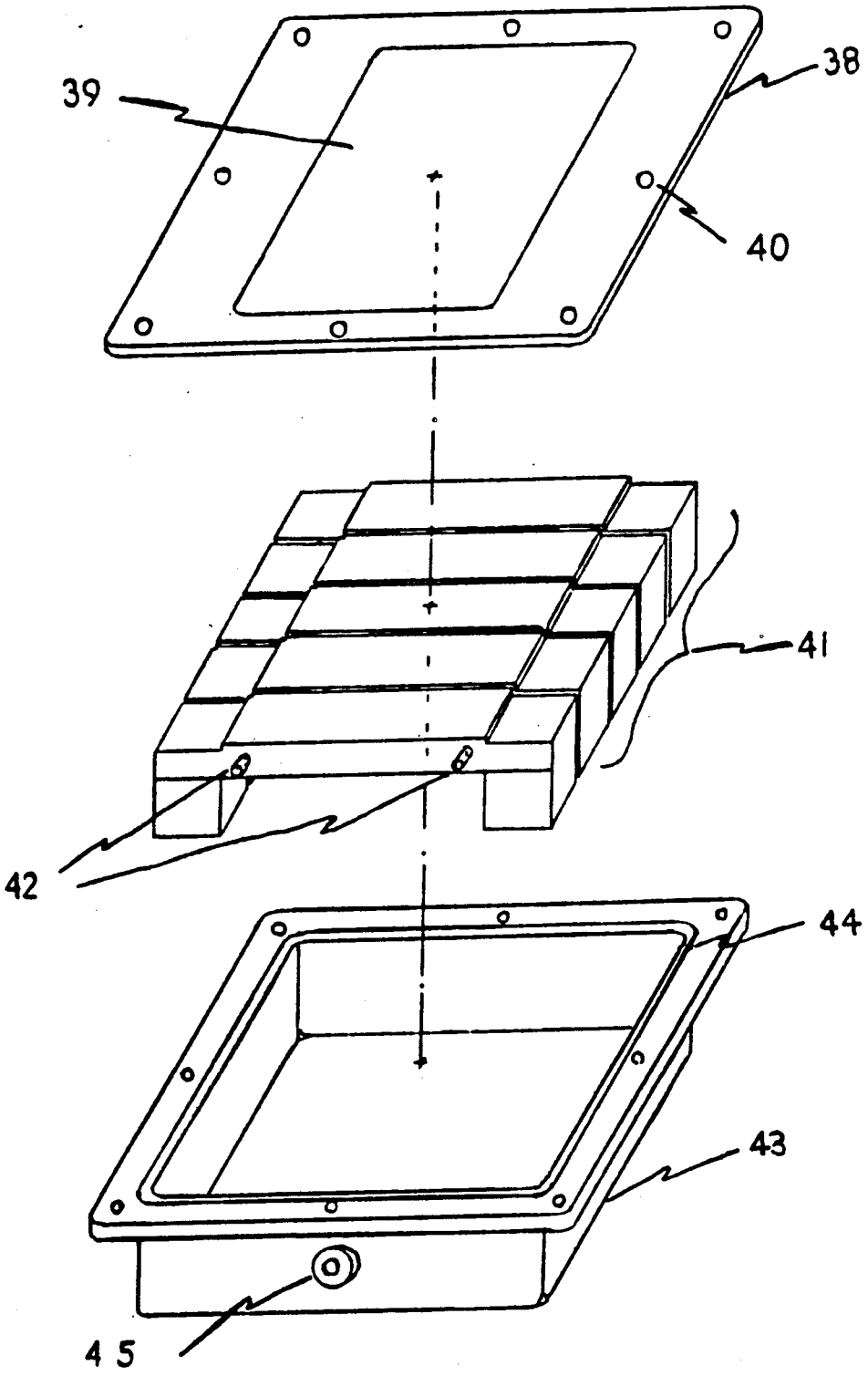
FIG. 15 is an exploded sketch showing the principal components of a sonar transducer module comprised of a plurality of FLEXBARs and termed a "FLEXDUCER" module, FIG. 16-A is a top view of a FLEXDUCER module comprised of 5 FLEXBARS of the design of FIG. 9-B, FIG. 16-B is an end view of the FLEXDUCER module of FIG. 16-A.

The FLEXBAR sonar transducer is comprised of one or more FLEXBARs, nodally mounted in a suitable water-tight housing, and acoustically coupled to the water through a sound-transparent rubber window. FIG. 15 is a schematic sketch showing the principal parts comprising such a transducer: the cover plate, 38, has a bonded sound-transparent rubber window, 39, with bolt holes, 40; an ensemble of FLEXBARs, 41, with nodal mounting pins, 42; and a flanged housing, 43, with an electrical cable, 44. In order to distinguish such a FLEXBAR transducer from one comprised of bender-bar elements, I have named it a "FLEXDUCER", and this terminology will be used throughout the rest of this specification.

FIG. 16-A, FIG. 16-B, and FIG. 16-C are, respectively, the top-view, the end-view, and the side-view of a FLEXDUCER module comprised of 5 FLEXBARs of the design shown in FIG. 9-B having element performance characteristics delineated above. FIG. 17-A, FIG. 17-B and FIG. 17-C are, respectively, the top-view, the side-view, and the end-view of sectional sketches showing certain design details of the FLEXDUCER construction. In this design, the FLEXBARs, 41, are mounted by means of their rubber covered nodal pins 42, to mounting lugs, 46, rigidly attached (actually cast) to the cover plate, 38. Thus, all 5 of the FLEXBARs are preassembled to the cover plate, and the sound-transparent rubber window, 39, is then molded to the cover plate and the radiating face of the FLEXBARs. The finished cover plate subassembly, after proper electrical connections are made to the driving cable, is then mounted onto the flange of the housing, 43, and secured by bolts, 45. An O-ring seal, 44, prevents water leakage in the housing.

Figure 18:
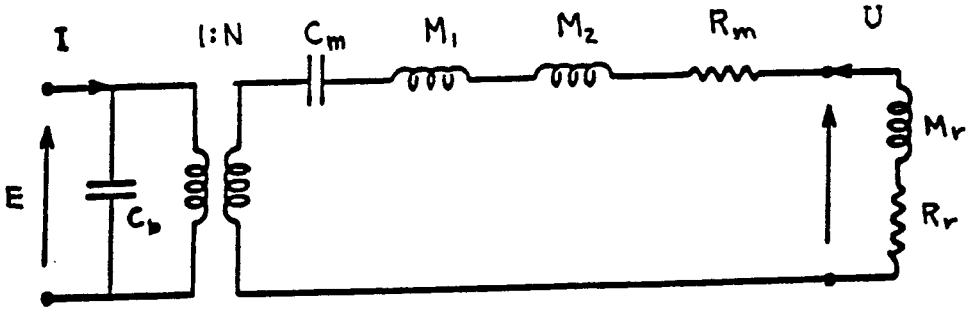
FIG. 18 is an equivalent circuit representation of the FLEXDUCER module of FIG. 16-A, FIG. 19 are curves showing both the measured and calculated transmitting response of the FLEXDUCER module of FIG. 16-A.

FIG. 18 shows a conventional equivalent circuit, that represents the response of the FLEXDUCER; the circuit components being defined as follows:

E = applied voltage

I = Electrical current $C_b$ = Electrical capacitance

1:N = Electromechanical transfer function $C_m$ = Mechanical compliance of the bar between the nodes $M_1$ = Mass of the bar between nodes $M_2$ = Total mass of bar ends beyond nodes Rm = Mechanical resistance of the bar $M_r$ = Radiation mass $R_r$ = Radiation resistance F=Force applied to the water load U=Mechanical current (velocity)

Figure 19:
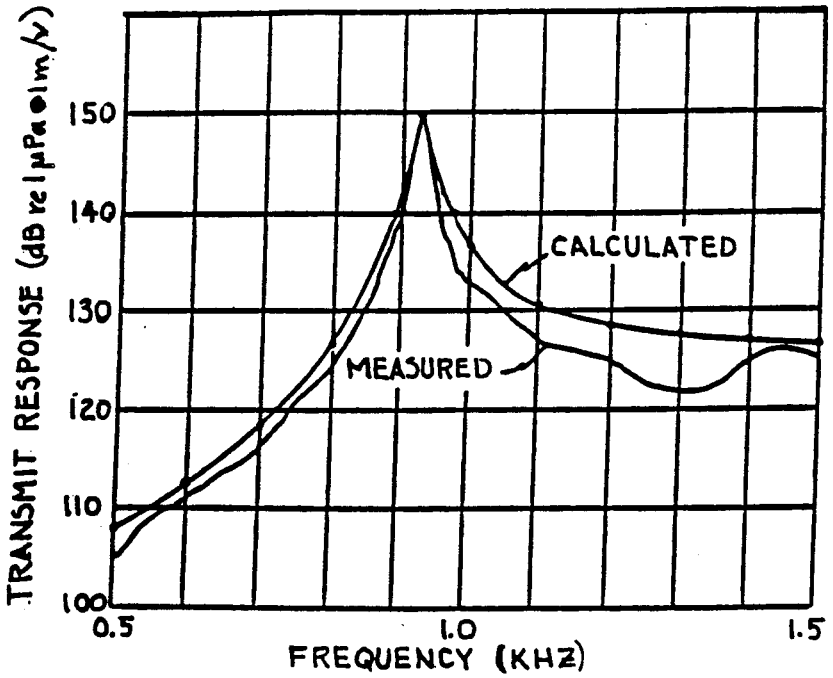

FIG. 19 shows both the calculated response of the FLEXDUCER, using appropriate values for the components of the equivalent circuit of FIG. 18, and the measured response. The correlation is excellent and validates the equivalent circuit representation. The efficiency was measured at ~70%.

Figure 20:
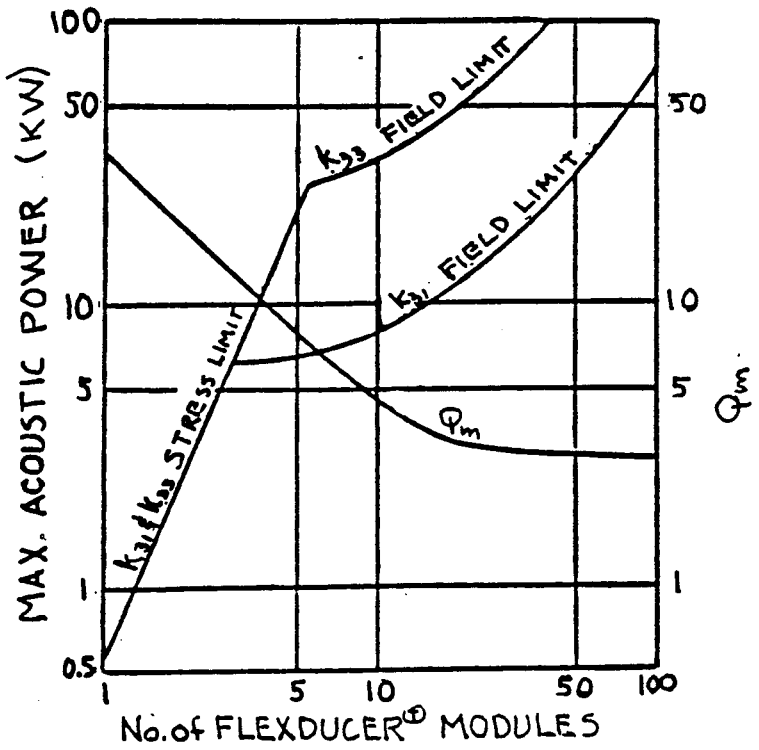
FIG. 20 shows the computed maximum acoustic power output and the mechanical Qm of a rectangular sonar array, comprised of a plurality of FLEXDUCER modules of FIG. 16-A, as a function of the number of modules in the array, FIG. 21 compares the measured housing vibration transmissibilities for a transducer module comprised of FLEXBARs and a transducer module comprised of the equivalent bender-bars.

The FLEXDUCER of FIG. 16-B, is intended to be a module of a large, highpower plane array with a nominal center frequency of 1 KHz. Since its dimensions (15"×15") are small compared to the wavelength (λ≐60"), the acoustic power output will be stress limited to ~600 acoustic watts. FIG. 20 shows the maximum acoustic power output as a function of the number of modules in a rectangular array. The transition from the stress-limited to the field-limited output occurs at approximately 6 modules. For 40 modules, the FLEXDUCER array would be capable of 100 KW of acoustic power output. The mechanical Qm drops from ~3.5 for a single module to ~3 for the full array of 40 modules due to the increase in radiation loading.

Figure 21:
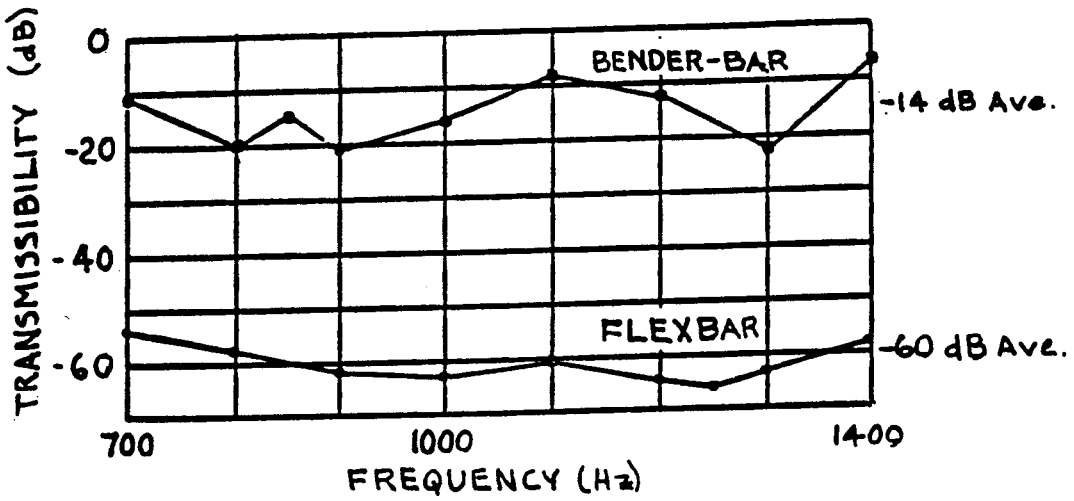

The importance of the nodal mounting of the FLEXBAR in the FLEXDUCER module and its effectiveness in virtually eliminating structure-borne vibration is demonstrated by the experimental data of FIG. 21. Here, a comparison of housing transmissibility is made between the FLEXBAR module and an equivalent conventional bender-bar module. In this case, the housing transmissibility is defined as the ratio of the vibration amplitude of the bar at its center to the vibration amplitude of the housing resulting from the vibration of the bar, in decibels; i.e., Transmissiblity=20 log (bar amplitude/housing amplitude). As can be seen, the FLEXBAR module has an average transmissiblity of −60 dB over a whole octave from 700–1,400 Hz; i.e., the amplitude of vibration of the housing is only 0.1% of that of the FLEXBAR. By contrast, the transmissibility of the bender-bar module is on the average, only −14 dB; i.e., the amplitude of vibration of the housing is 20% of that for the bender-bar. The significance of this difference becomes clear if we consider a large, high-power array capable of an acoustic output of 0.5 megawatts. The back radiation from the FLEXDUCER array would only be of the order of 0.5 acoustic watts; while the bender-bar array would have back radiation of ~20,000 watts.

Obviously many modification and variations of my invention are possible in the light of the above teachings. It is therefore understood that within the scope of the appended claims my invention may be practiced otherwise than specifically described, as will be evident to those skilled in the transducer art.

I claim:

1. An improved underwater acoustic transducer comprised of: a free-free flexure bar; means for electromechanically driving the said bar in flexural vibration over a band of frequencies having as its central frequency a frequency, substantially corresponding to the lowest free-free flexural mode of the said bar; means for mounting said flexure bar substantially at the two nodal lines characteriatic of the said lowest free-free flexural vibrational mode of the said bar, said mountings having elastomeric members partially isolating said mountings from the vibration of the said flexure bar; means for affixing said flexure bar and its said nodal mountings into a gas-filled water-tight housing in such a manner that the flexure bar can vibrate freely on its nodal mountings without substantial mechanical coupling to said mountings or said housing; means for mechano-acoustically coupling to the water only the central portion of the outer surface of said mounted bar lying between the said two nodal lines, so that when electromechanically driven in flexural vibration, the said flexure bar will radiate acoustic energy into the water from said central portion; means for allowing those outer portions of said flexure bar lying outside of the said two nodal lines to vibrate freely in the gas-filled interior of said housing without mechano-acoustic coupling to the water, thus preventing acoustic radiation from said outer portions which would be out of phase with said acoustic radiation from said central portion; and thus allowing the said underwater acoustic transducer to radiate acoustic energy into the water essentially as a monopole, rather than a dipole.

2. An improved underwater acoustic transducer as set forth in claim 1, but comprised of a plurality of said free-free flexure bars.

3. An improved underwater acoustic transducer as set forth in claim 1 or claim 2 wherein the free-free flexure bar is comprised of two modified end sections lying outside of the nodal lines of the said free-free flexure bars which are rigidly attached to the central portion of the said free-free bar and extend at substantially right angles to, and on the opposite side of, the central radiating surface of the said free-free flexure bar, where said end sections would provide substantially the same total inertia, both translational and rotational, taken about the nodal lines, as would be provided by uniform end sections extending outside of the nodal lines and parallel to the central radiating face of the free-free flexure bar.

4. An improved underwater acoustic transducer as set forth in claim 3 wherein the said free-free flexure bar is comprised of said modified end sections which have a portion of their surfaces that are contiguous with the central radiating surface recessed so as to avoid vibrational interference with a transducer cover plate.

5. An improved underwater acoustic transducer comprised of said free-free flexure bars as set forth in claim 3 wherein the means for electromechanically driving said bars in flexural vibrations is a piezoelectric means.

6. An improved underwater acoustic transducer comprised of said free-free flexure bars as set forth in claim 3 wherein the means for electromechanically driving said bar in flexural vibration is a magnetostrictive means.

7. An improved underwater acoustic transducer comprised of said free-free flexure bars as set forth in claim 3 wherein the means for electromechanically driving said bar in flexural vibration is a magnetic electrodynamic (moving-coil) means.

8. An improved underwater acoustic transducer comprised of said free-free flexure bars as set forth in claim 3 wherein the means for electromechanically driving said bar in flexural vibration is a variable magnetic reluctance (moving-armature) means.

9. An improved underwater acoustic transducer comprised of said free-free flexure bars as set forth in claim 5 wherein the piezoelectric means is one of the class of polarized piezoceramics.

10. An improved underwater acoustic transducer comprised of said free-free flexure bars as set forth in claim 9 wherein means are provided to subject the polarized piezoceramic to a substantially permanent precompression mechanical bias in the course of fabrication of said bars.

11. An improved vibratile element, suitable for use in a transducer, comprised of: a free-free flexure bar; means for electromechanically driving said bar in flexural vibration over a band of frequencies having as its central frequency a frequency substantially corresponding to the lowest free-free flexural vibrational mode of the said bar; means for mounting said flexure bar substantially at the two nodal lines characteristic of the said lowest free-free flexural vibrational mode of the said bar, said mountings having elastomeric members partially isolating said mountings from the vibrations of said flexure bar; two modified end sections lying outside of the nodal lines of the said free-free flexure bars which are rigidly attached to the central portion of said free-free bar and extend at substantially right angles to, and on the same side of, central portion of said bar, where said end sections would provide substantially the same total inertia, both translational and rotational, taken about the nodal lines, as would be provided by uniform end sections extending outside of the nodal liens and parallel to the central portion of said free-free flexure bar.

12. An improved vibratile element, suitable for use in a transducer, as set forth in claim 11, wherein means are provided to change the mass of said modified end sections so as to change the frequency substantially corresponding to the lowest free-free flexural vibrational mode of said bar.

13. An improved vibratile element, suitable for use in a transducer, as set forth in claim 11, wherein means are provided to change the moment of inertia, taken about the nodal lines, of said modified end sections so as to change the frequency substantially corresponding to the lowest free-free flexural vibrational mode of said bar.

14. An improved vibratile element, suitable for use in a transducer, as set forth in claim 11, or claim 12, or claim 13, wherein the means for electromechanically driving said vibratile element in flexural vibration is a piezoelectric means.

15. An improved vibratile element, suitable for use in a transducer, as set forth in claim 11, or claim 12, or claim 13, wherein the means for electromechanically driving said vibratile element in flexural vibration is a magnetostrictive means.

16. An improved vibratile element, suitable for use in a transducer, as set forth in claim 11, or claim 12, or claim 13, wherein the means for electromechanically driving said vibratile element in flexural vibration is a magnetic electrodynamic (moving-coil) means.

17. An improved vibratile element, suitable for use in a transducer, as set forth in claim 11, or claim 12, or claim 13, wherein the means for electromechanically driving said vibratile element in flexural vibration is a variable magnetic reluctance (moving-armature) means.

18. An improved vibratile element as set forth in claim 14 wherein the piezoelectric means is one of a class of polarized piezoceramics.

19. An improved vibratile element as set forth in claim 15 wherein means are provided to subject the polarized piezoceramic to a substantially permanent precompression mechanical bias in the course of fabrication of the said vibratile element.

20. An improved vibratile element as set forth in claim 19, wherein a pair of tapered wedges are the means for obtaining the said mechanical bias.

21. An improved vibratile element as set forth in claim 19, wherein a pair of tapered pins and matching blocks are the means for obtaining the said mechanical bias.

22. An improved vibratile element as set forth in claim 19, wherein a pair of tapered threaded bolts and matching block are the means for obtaining the said mechanical bias.

* * * * *